US005083601A

United States Patent [19]

Tedeschi

[11] Patent Number: 5,083,601

[45] Date of Patent: Jan. 28, 1992

[54] SUPPORT FOR ROLL-UP CURTAINS

[75] Inventor: Giovanni Tedeschi, Funo di Argelato, Italy

[73] Assignee: Sunproject S.r.l., Bologna, Italy

[21] Appl. No.: 695,930

[22] Filed: May 6, 1991

[30] Foreign Application Priority Data

Jun. 27, 1990 [IT] Italy ..... 4856/90[U]

[51] Int. Cl.[5] ..... A47G 5/02

[52] U.S. Cl. ..... 160/323.1; 160/324

[58] Field of Search ..... 160/323.1, 324, 321, 160/325, 326; 248/266, 267, 268

[56] References Cited

U.S. PATENT DOCUMENTS 729,881 6/1903 Mathis ..... 248/268

1,782,131 11/1930 Broberg ..... 248/267

2,912,209 11/1959 Turner ..... 248/266

*Primary Examiner*—Blair M. Johnson

*Attorney, Agent, or Firm*—Darby & Darby

[57] ABSTRACT

A support for a roll-up curtain comprises a pair of cylindrical bodies fastened to a wall, each one featuring a transverse recess, open in a front side of the body, for receiving a clamping element with a seating into which an end of a shaft of a roller of the roll-up curtain is introduced. One clamping element is introduced and clamped elastically into the transverse recess of each body, so as to restore the continuity of the cylindrical surface of the body and in such a way that a border of the curtain covers, at least partially, the body, when the support is mounted.

10 Claims, 2 Drawing Sheets

1
2
2a
2b
2c
3
4
5
6
7
8
9
10
11
12
14
15
16
17
18
26

SUPPORT FOR ROLL-UP CURTAINS

BACKGROUND OF THE INVENTION

The present invention relates to the technical field concerning the production of roll-up curtains, for instance for closing a window to darken a room or for closing a window with a net to avoid insects to enter a room.

DESCRIPTION OF THE PRIOR ART

Roll-up curtains are known, assembled on a roller which is supported at the ends by means of two supports, fastened overhanging from the wall at the top of the window to be darkened.

Each support features a seating where an end portion of the roller shaft, protruding axially with respect to the roll-up curtain, engages when the assembly is mounted.

A known support of this kind, rather inexpensive, basically consists of a metal section, forming a shelf bearing a hole, into which the end of the roller shaft is inserted.

Because the roller shaft easily comes out of the support seatings, it is necessary to set each support with high accuracy as for correct alignment and right distance in respect of the opposit support, in order to avoid detaching of the curtain.

For this reason supports of this kind are quite difficult to be installed.

Another known support, improved in respect of the previously described one, has a clamping element which fits into a part fastened to a wall, so as to keep the roller shaft.

However, the supports remain still visible at the ends of the roller, with an obvious prejudice from the aesthetic point of view.

Furthermore, owing to the overall dimensions of the two supports projecting from the wall, two areas remain not darkened at the sides of the curtain.

SUMMARY OF THE INVENTION

The object of the present invention is to provide a support for roll-up curtains easy and quick to be installed, as well as invisible when mounted.

A further object of the present invention is to provide a support for roll-up curtains made by means of a technical solution which is simple, functional and reliable, as well as versatile.

The above-mentioned objects are achieved through a support for roll-up curtains comprising a pair of cylindrical bodies, each one designed to be fastened to a wall and bearing a transverse recess open in the front side of the same body.

A pair of clamping elements each one featuring a seating for an end of a shaft of a roller of a roll-up curtain, are introduced and clamped elastically into the transverse recesses of the bodies, so as to restore the continuity of the cylindrical surface of each body in such a way that the side borders of the roll-up curtain, larger than the roller, cover, at least partially, the bodies.

BRIEF DESCRIPTION OF THE DRAWINGS

The invention will be described further, by way of example, with reference to the accompanying drawings, wherein.

DESCRIPTION OF THE PREFERRED EMBODIMENT

Figures 1, 2, 3:
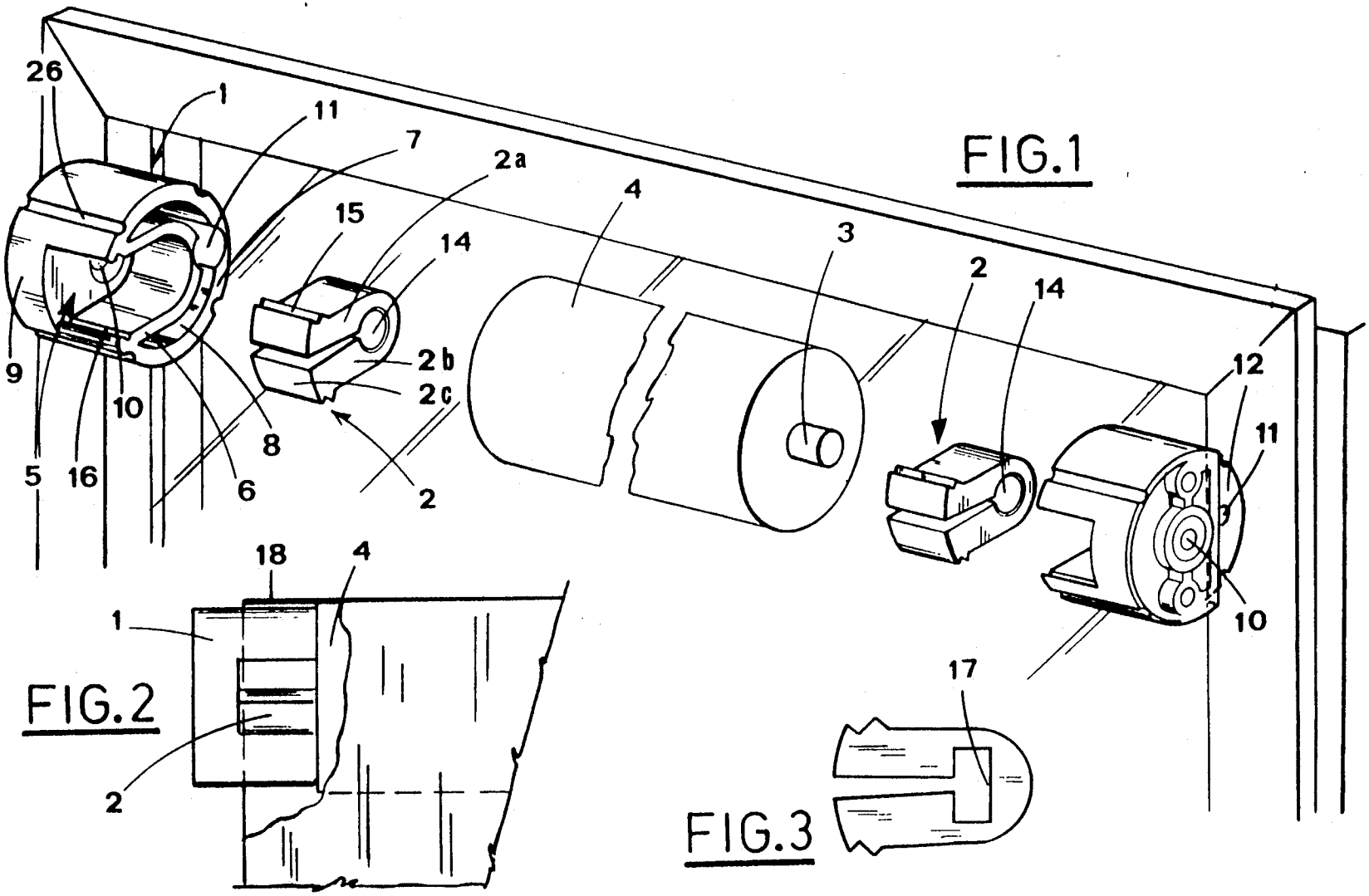
FIG. 1 is a perspective view of a pair of supports conforming to the present invention, concurring in the assembling of a roll-up curtain.
FIG. 2 is a side view of the support mounted.
FIG. 3 shows a different embodiment of the clamping element.

Referring to the above-mentioned figures, the support for roll-up curtains basically comprises a body 1, designed to be fastened to a wall, and an elastic element 2, designed to clamp the shaft 3 of a conventional roller 4 bearing the roll-up curtain.

The body 1 has basically a cylindrical shape and includes a radial recess 5, into which the clamping element 2 can be inserted elastically.

The recess 5 is delimited by a U-shaped wall that matches with the outer surface of the clamping element 2.

Between the inner wall 6 and the outer cylindrical wall 7 there is a hollow 8, made for lightening purposes.

The recess 5 and the hollow 8 extend axially from the body 1, starting from the front end of the same body 1, up to a plate 9 for wall-mounting.

The plate 9 is provided with an axial hole 10 through which a screw, not illustrated, is designed to pass for fastening the support to the wall.

A second hole 11 for a screw is made in the plate 9 and it is positioned so as to result in the middle of the hollow 8. The hole 11 partially affects also the walls 6,7.

The hole 11 leads to an embedding 12 made in the rear face of the plate 9. The embedding 12 defines a step transverse in respect of the recess 5.

The step allows the body 1 to be fastened to the edge of a jamb 13 of a window, in this case, through the hole 11.

The fastening obviously results to be alternative to the fastening on a plane surface, provided through hole 10.

The clamping element 2 consists of a U-shaped clip with a seating 14 with circular section for the insertion of the shaft 3 of the roller 4.

Each one of two prongs 2*a*, 2*b* of each clip features, on the outer surface and close to the ends, a tooth 15 extending parallel to the axis of the seating 14.

The teeth 15 can engage with corresponding grooves 16 made on the wall 6 that delimitates the recess 5 of the support body 1.

The ends of the roller shaft 3 are respectively inserted in two clamping elements 2, and then the roller 4 with the clamping elements 2 is assembled on a pair of bodies 1, previously fastened to the wall, by inserting the clamping elements 2 into the recesses 5 of the bodies 1.

When they are introduced into the recess 5, the prongs 2*a*, 2*b* of each clamping element 2 are elastically clamped, thus remaining locked inside the body 1.

The teeth 15 engaging with the grooves 16 avoid the clamping elements 2 to come out from the recesses 5.

It will be appreciated, however, that the clamping of the prongs 2*a*, 2*b* leaves the shaft 3 ends free to rotate within the seating 14 of the clamping element 2.

According to a different embodiment, the clamping element 2 has a prismatic seating 17, as shown in FIG. 3.

The seating 17 is suited to engage with a flattened portion of the shaft of the roller 4, provided in some embodiments of the roll-up curtain.

In particular, it is to be pointed out the fact that the body 1 of the support has a slightly smaller diameter than that of the roller 4; furthermore, the clamping element 2 presents, transverse to the prongs 2*a*, 2*b*, a rounded surface 2*c* that, when the support is mounted, is able to restore the continuity of the cylindrical surface of the body 1, so that the support features the axial extension of the same roller.

This allows the side borders of the roll-up curtain to extend over the supports, as it may be seen in FIG. 2 where the same curtain is indicated by the numeral 18.

Therefore the supports described above are not virtually visible, when mounted. Furthermore, the curtain may extend nearly up to the wall, so as to darken the window completely.

Figure 5:
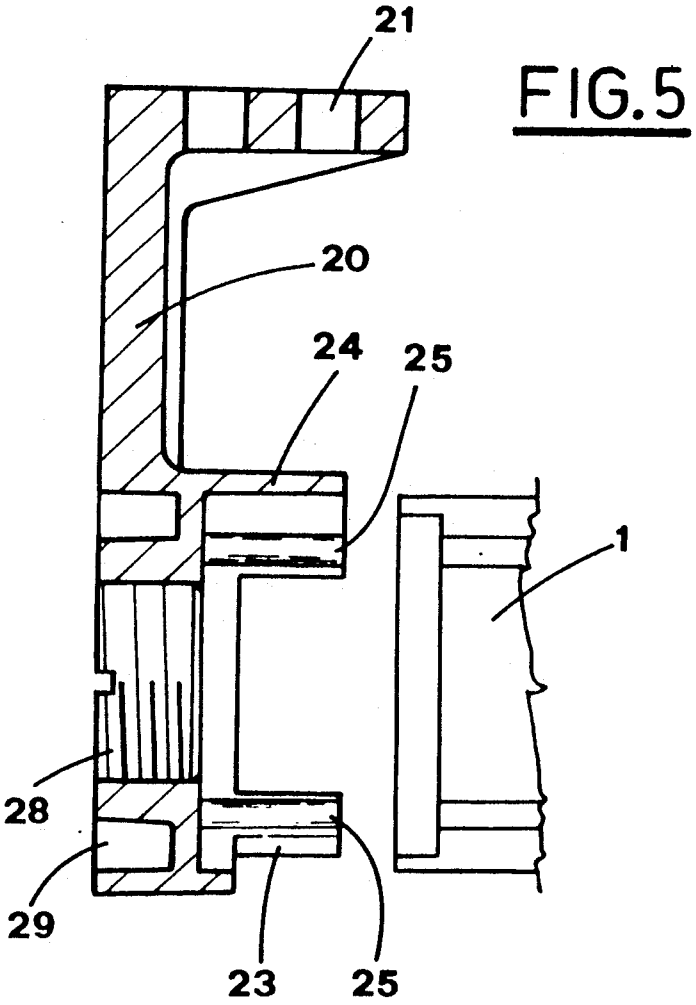
FIG. 5 is a sectional view according to the line V—V of FIG. 4.
Figure 4:
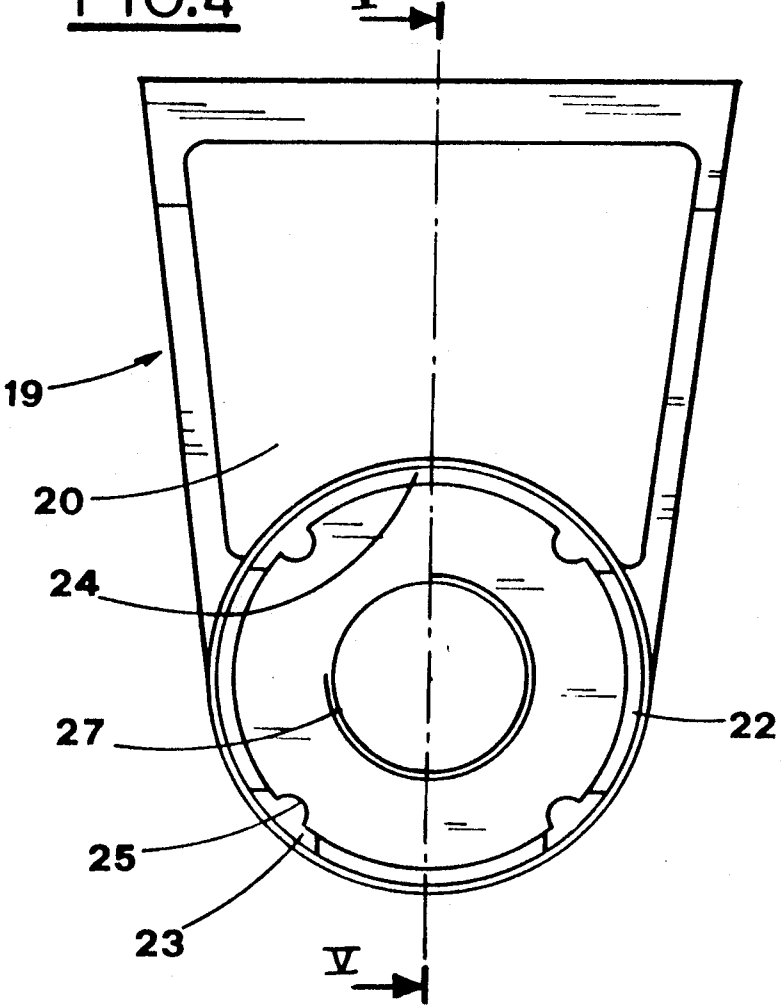
FIG. 4 is a front view of an attachment to mount said support overhanging.

FIGS. 4, 5 and 6 show a holder, indicated as a whole by the numeral 19, which may be associated with the support described above, to install a roll-up curtain overhanging.

The holder 19 consists of a square-shaped flange 20, fitted with a pair of slots 21.

The flange 20 can be fastened to the wall by means of screws which pass through the slots 21, so that the position of the holder can be adjusted.

The flange 20 features a cylindrical mouth 22 provided with rounded extensions.

More particularly, there are two extensions 23, each one offset by an angle of 90 degrees in respect of the other, and a further larger extension 24 facing the extensions 23.

The body 1 of the support is inserted between the extensions 23,24 and then into the mouth 22, so as to be housed therein.

To avoid rotation of the body 1, there are longitudinal ribs 25 made along the extensions 23, 24, which engage with corresponding grooves made on the outer surface of the body 1.

Furthermore, the flange 20 bears a threaded hole 27, coaxial with the mouth 22, into which a dowel 28 is screwed for purpose of adjusting the axial position of the body 1 of the support.

The hole 27 is surrounded by an annular groove 29 for lightening purposes.

The extensions 23, 24 leave three openings between each other, through which the clamping element 2 mounted on the roller 4 can be inserted into the recess 5.

Therefore the body 1 may be mounted in the most convenient position, in order to facilitate the subsequent assembling of the roll-up curtain.

WHAT IS CLAIMED IS:

1. A support for roll-up curtains comprising:

a pair of cylindrical bodies, each of said bodies being designed to be fastened to a wall and bearing a transverse recess open in a front side of said body:

a pair of clamping elements, each one of said elements featuring a seating for an end of a shaft of a roller of a roll-up curtain;

said clamping element being introduced and clamped elastically into said transverse recess of said body, so as to restore the continuity of a cylindrical surface of said body, in such a way that a side border of said roll-up curtain larger than said roller, covers, at least partially, said body.

2. A support as claimed in claim 1, wherein said clamping element consists of a U-shaped clip comprising two prongs and a circular seating for insertion therein of said shaft of said roller.

3. A support as claimed in claim 2, wherein each one of said prongs of said clip has a tooth made on an outer surface of said prong, close to an end of said prong, said tooth extending parallel to the axis of said seating, and engaging with a corresponding groove provided on an inner wall of said recess of said body.

4. A support as claimed in claim 1, wherein said recess is delimited by a U-shaped wall which couples with said outer surface of said clamping element, said recess extending from a front end of said body, up to a plate provided in said body for wall-mounting.

5. A support as claimed in claim 4, wherein said plate has an axial hole designed to be crossed by a screw.

6. A support as claimed in claim 1, wherein said body bears in its rear face an embedding defining a step transverse to the axis of said recess, with a hole leading to said embedding and designed to be crossed by a screw, to fasten said body close to an edge of a jamb of a window to be closed by said curtain.

7. A support as claimed in claim 1, comprising a holder for installing said roll-up curtain overhanging, said holder consisting of a square-shaped flange, and featuring a cylindrical mouth provided with rounded extensions delimiting a housing for said body.

8. A support as claimed in claim 7, wherein said mouth has a pair of extensions, first extension and second extension respectively, with said first extension offset by an angle of 90 degrees in respect of said second extension, and a third extension, larger than said first and second extensions, said third extension facing said first and second extensions.

9. A support as claimed in claim 7, wherein each of said extensions features a longitudinal rib engaging with a corresponding groove provided on the outer cylindrical surface of said body.

10. A support as claimed in claim 7, wherein said flange bears a threaded hole, coaxial with said mouth, into which a dowel is screwed for adjusting the axial position of said body inside said mouth.

* * * * *